US009905963B1

(12) United States Patent
Scholl et al.

(10) Patent No.: US 9,905,963 B1
(45) Date of Patent: Feb. 27, 2018

(54) ADJUSTABLE STRAIN RELIEF FOR ELECTRICAL CONNECTORS

(71) Applicant: TE CONNECTIVITY CORPORATION, Berwyn, PA (US)

(72) Inventors: Christopher Allen Scholl, Murrieta, CA (US); Christoph Joseph Novak, Irvine, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 2 days.

(21) Appl. No.: 15/419,401

(22) Filed: Jan. 30, 2017

(51) Int. Cl.
*H01R 13/58* (2006.01)
*H01R 13/512* (2006.01)

(52) U.S. Cl.
CPC ..... *H01R 13/5829* (2013.01); *H01R 13/512* (2013.01)

(58) Field of Classification Search
CPC ..... H01R 13/5829; H01R 13/512
See application file for complete search history.

(56) References Cited

U.S. PATENT DOCUMENTS 4,653,848 A * 3/1987 Kloots ..... G02B 6/3807 385/100
4,842,550 A * 6/1989 Fry, Jr. ..... H01R 13/5829 439/464
5,839,911 A * 11/1998 Dinkel ..... H01R 13/582 439/470
5,933,557 A * 8/1999 Ott ..... G02B 6/3887 385/86
6,111,201 A * 8/2000 Drane ..... H01R 4/70 174/92
6,419,519 B1 * 7/2002 Young ..... H01R 13/5812 439/446
6,634,801 B1 * 10/2003 Waldron ..... G02B 6/3887 385/135
7,641,504 B1 * 1/2010 Padruzzi ..... H01R 13/516 439/464
7,862,369 B2 * 1/2011 Gimenes ..... H01R 13/5812 439/446
8,435,066 B2 * 5/2013 Myong ..... H01R 9/032 439/452
8,568,158 B2 * 10/2013 Mangus ..... H01R 13/5812 439/465
9,118,158 B2 * 8/2015 Kern ..... H01R 43/00
9,553,402 B2 * 1/2017 Thelen ..... H01R 13/502
9,627,800 B2 * 4/2017 Taylor ..... H01R 13/5841
2009/0111321 A1 * 4/2009 Baldwin ..... H01R 13/5829 439/471
2011/0028028 A1 * 2/2011 Moorehead, Jr. .. H01R 13/5812 439/470
2014/0265308 A1 * 9/2014 Reilly ..... H01R 13/5841 285/153.1

* cited by examiner

*Primary Examiner* — Briggitte R Hammond

(57) ABSTRACT

A backshell assembly with a strain relief member. The backshell assembly includes an enclosure member for positioning over a connector. The enclosure member has a wire receiving portion which extends from a surface of the enclosure member. A strain relief mounting member extends from the enclosure. The strain relief member is movably mounted to the strain relief mounting member. The strain relief member is movable between 0 degrees and 90 degrees as measured between a center axis a wire mounting opening of the wire receiving portion to a center axis of a wire receiving opening of the strain relief member.

13 Claims, 6 Drawing Sheets

ADJUSTABLE STRAIN RELIEF FOR ELECTRICAL CONNECTORS

FIELD OF THE INVENTION

The present invention relates to a backshell assembly with an adjustable stain relief member that can be positioned in multiple orientations

BACKGROUND OF THE INVENTION

Backshell assemblies are generally known in the art. Such backshell assemblies normally provide a transition from a plurality of electrical conductors to an electrical connector.

Various types of backshell assemblies are known and configured to provide a relatively wide range of options, depending on the particular application. One such application is strain relief. In particular, backshell assemblies are known which provide a clamping force relative to the cable or wires to prevent axial forces from damaging the termination of the wires at the electrical connector. Such known backshell assemblies normally include a mechanical clamp or strain relief member rigidly secured to the backshell adapter assembly. Conventional fasteners are used to tighten portions of the stain relief member together to provide the clamping force required to prevent the cable or wires from moving in an axial direction.

Depending on the application, various configurations of the backshell assemblies with strain relief members are known in which the fixed angle of the axes of the strain relief members relative to the axis of the backshell adapter assembly varies. For example, 0 degrees, 45 degrees or 90 degrees configurations are all known. In each of these configurations, the backshell adapter assembly includes a stain relief member fixed at either 0 degrees, 45 degrees or 90 degrees relative to the axis of the backshell adapter assembly. Since the strain relief members are fixed relative to the backshell adapter assembly, the 0 degrees, 45 degrees or 90 degrees backshell assemblies with strain relief members must be manufactured as separate products. As such, separate tooling must be provided for each of the various configurations which increases the cost of backshell assemblies with a strain relief function. In addition, the end user must have an accurate count of each of the configurations required before ordering the backshell assemblies. Should a field change be required, additional backshell assemblies may be required to be ordered.

It would, therefore, be beneficial to optimize backshell assemblies with various configurations. In particular, it would be beneficial to provide a stain relief member which could be oriented at different angles relative to the axis of the backshell assembly.

SUMMARY OF THE INVENTION

An object is to provide a backshell assembly with a stain relief member that can be positioned in multiple orientations.

An embodiment is directed to a backshell assembly with a strain relief member. The backshell assembly includes an enclosure member for positioning over a connector. The enclosure member has a wire receiving portion which extends from a surface of the enclosure member. A strain relief mounting member extends from the enclosure. The strain relief member is movably mounted to the strain relief mounting member. The strain relief member is movable between 0 degrees and 90 degrees as measured between a center axis a wire mounting opening of the wire receiving portion to a center axis of a wire receiving opening of the strain relief member.

An embodiment is directed to a backshell assembly with a strain relief member. The backshell assembly includes an enclosure member for positioning over a connector. The enclosure member has a wire receiving portion which extends from a surface of the enclosure member. A strain relief mounting member extends from the enclosure. The strain relief member is movably mounted to the strain relief mounting member. The strain relief member is movable between a center axis a wire mounting opening of the wire receiving portion to a center axis of a wire receiving opening of the strain relief member. Mounting hardware cooperates with the strain relief mounting member and the strain relief member. The mounting hardware provides stops to position and maintain the strain relief member at 0 degrees, 45 degrees and 90 degrees relative to the wire receiving portion of the enclosure.

An embodiment is directed to an adjustable strain relief assembly for use with a connector. The strain relief assembly includes a strain relief mounting member extending from the connector. The strain relief member is movably mounted to the strain relief mounting member, wherein the strain relief member is movable between 0 degrees and 90 degrees as measured between a center axis of a wire mounting opening of the connector to a center axis of a wire receiving opening of the strain relief member.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
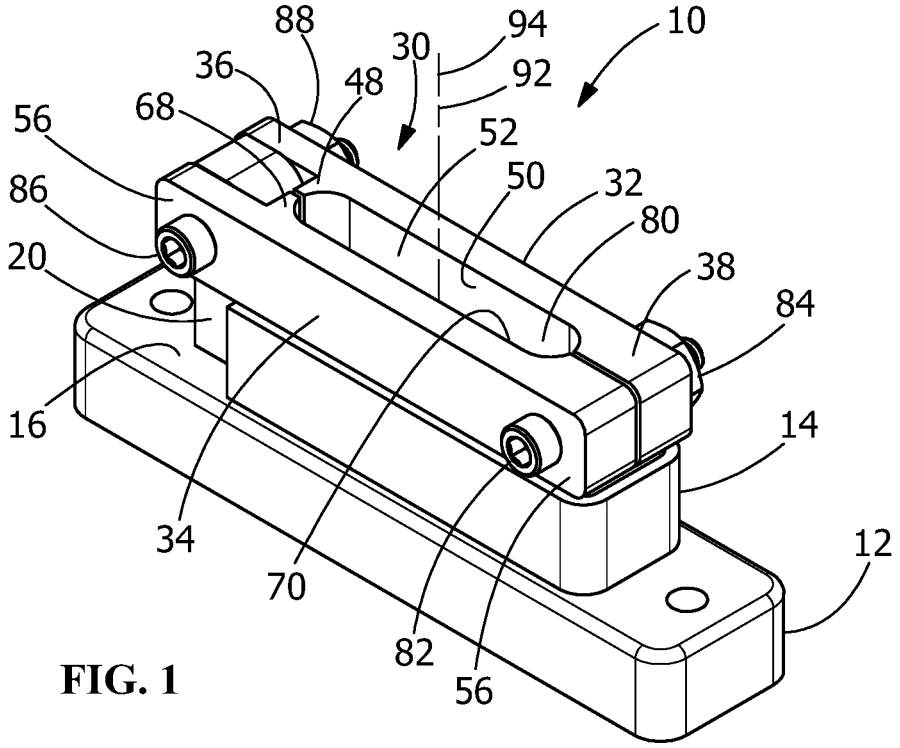
FIG. 1 is a perspective view of an illustrative movable strain relief member of the present invention, the strain relief is shown in a first position.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom"

as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 2:
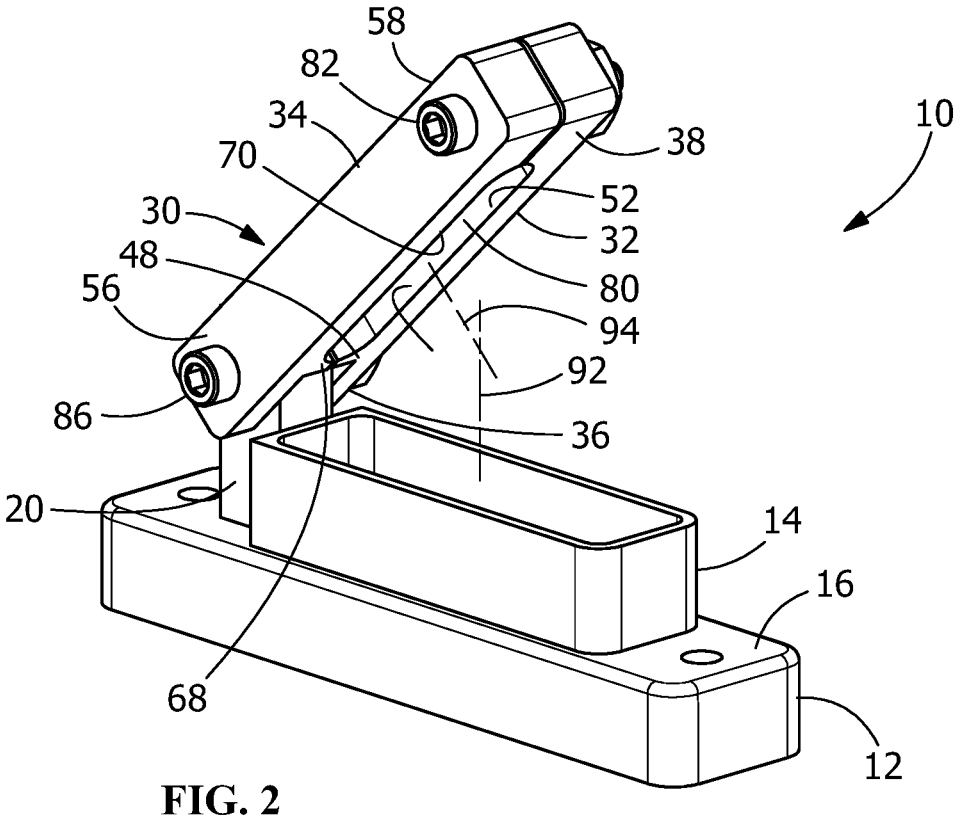
FIG. 2 is a perspective view of the strain relief member of FIG. 1 shown in a second position.
Figure 3:
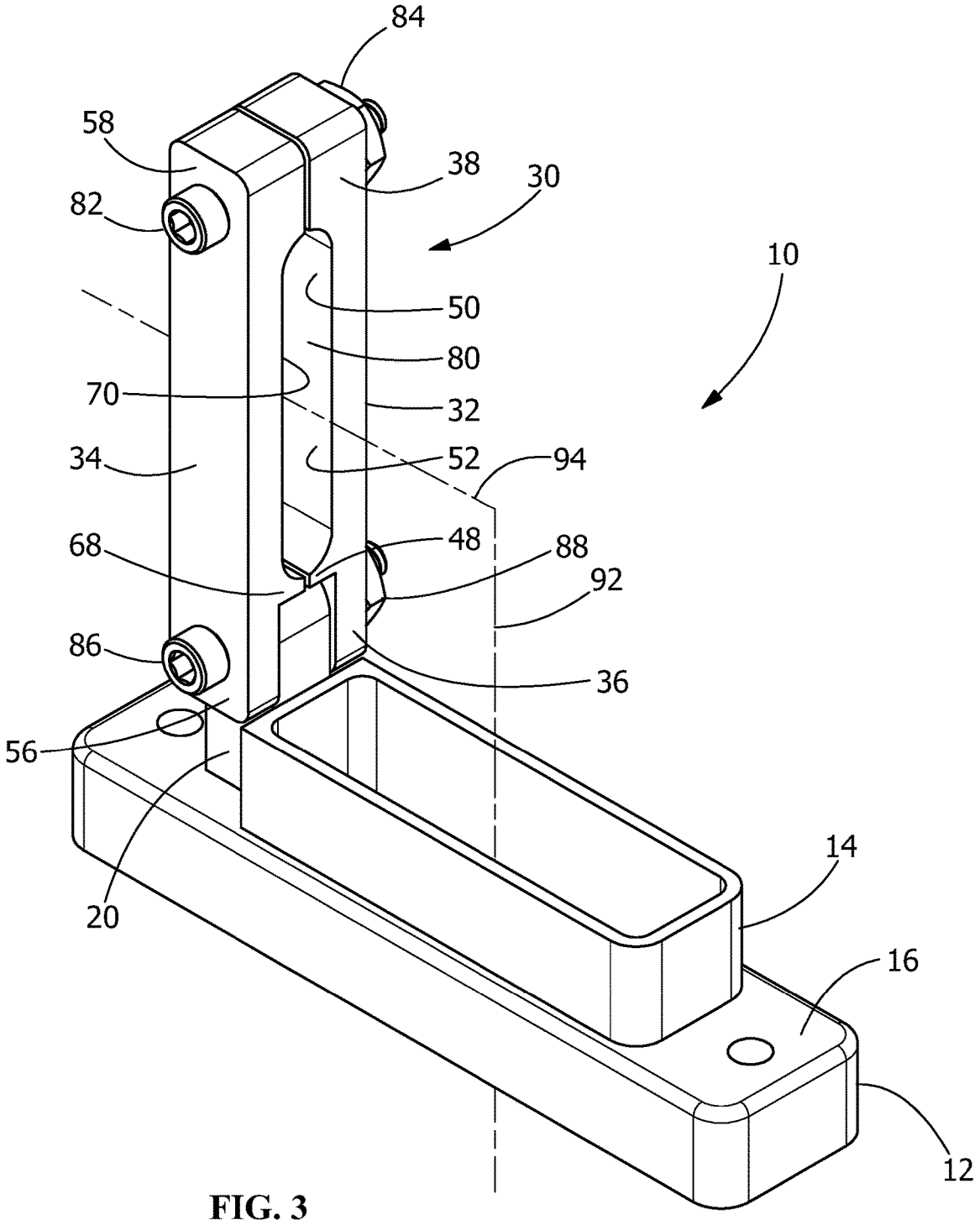
FIG. 3 is a perspective view of the strain relief member of FIG. 1 shown in a third position.

As best shown in FIGS. 1 through 3, the backshell assembly 10 includes an enclosure 12 with a wire receiving portion 14 extending from a surface 16 of the enclosure 12. While an illustrative embodiment of the enclosure 12 and wire receiving portion 14 is shown, the enclosure 12 and wire receiving portion 14 can be of various configurations to properly cover or interact with an electrical connector, such as, but not limited to a subminiature D connector. The enclosure 12 and wire receiving portion 14 may be made from any material having the appropriate electrical and strength characteristics needed for the application.

A strain-relief mounting member 20 extends from and is mounted to the enclosure 12. In the embodiment shown, the strain-relief mounting member 20 extends from the surface 16 of the enclosure 12 proximate the wire receiving portion 14. The strain-relief mounting member 20 extends from the surface 16 past the free end of the wire receiving portion 14. The strain-relief mounting member 20 has a generally rectangular configuration, however, other configurations can be used.

Figure 4:
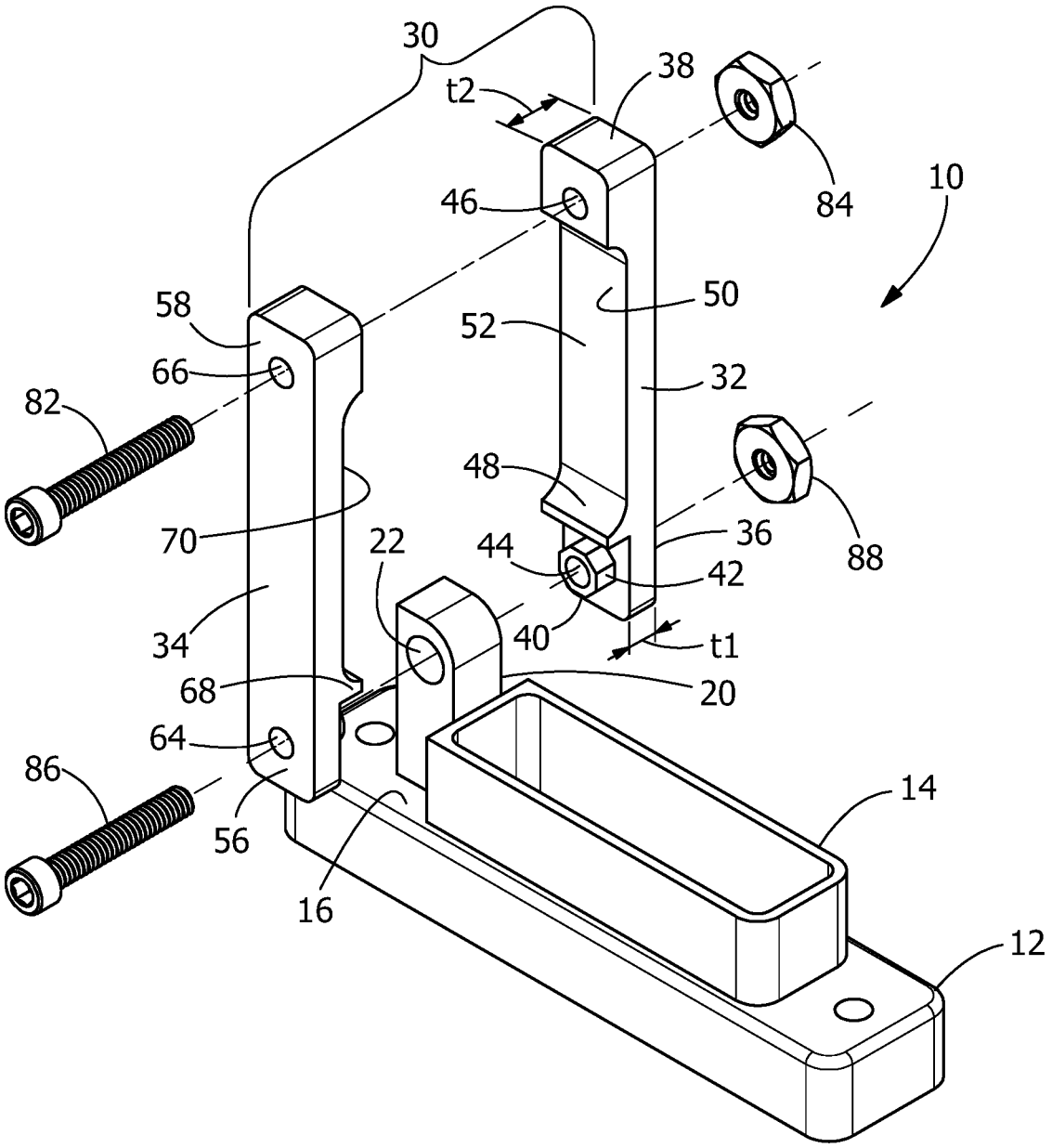
FIG. 4 is a front exploded perspective view of the strain relief member exploded from the backshell.
Figure 5:
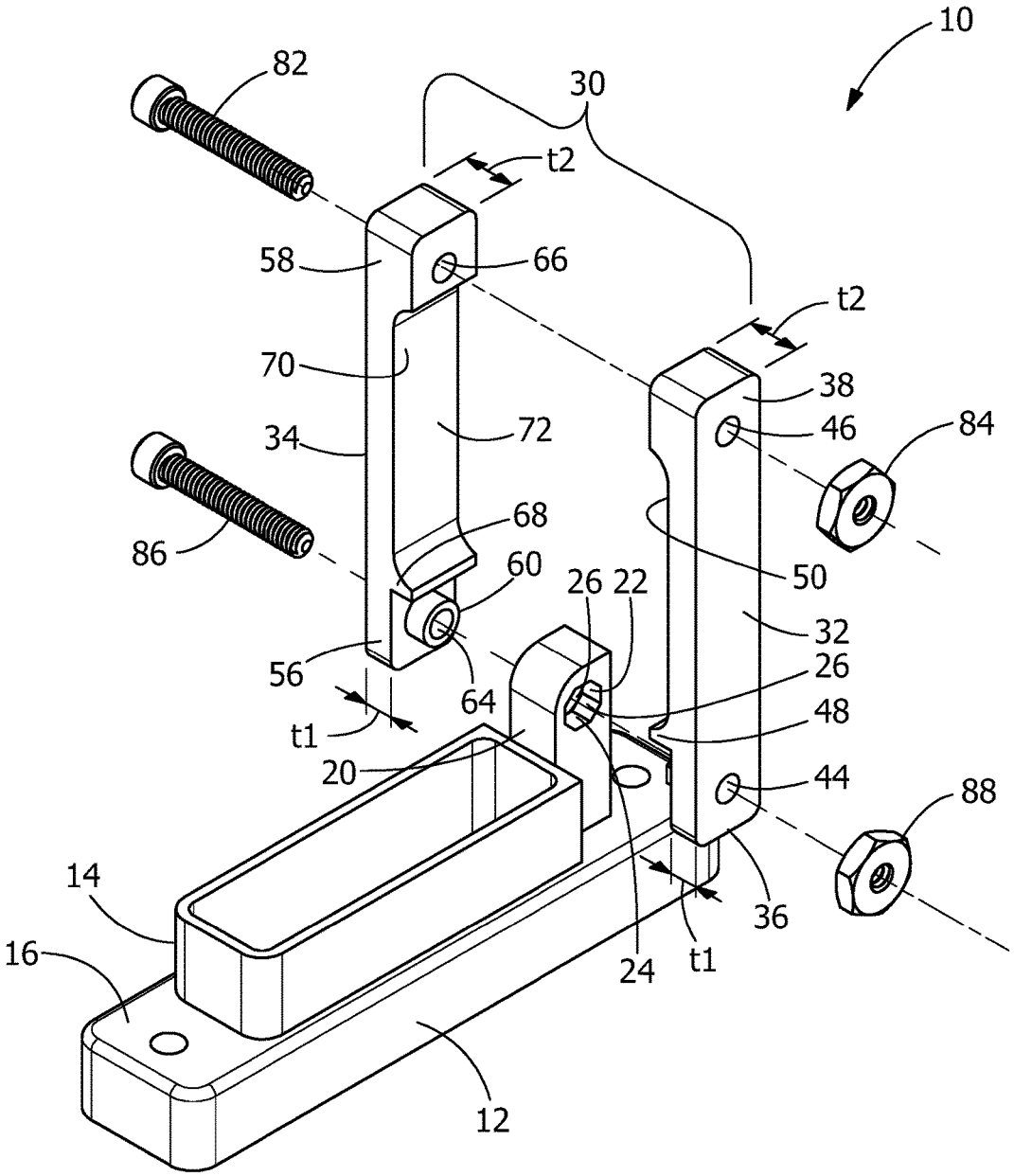
FIG. 5 is a back exploded perspective view of the strain relief member exploded from the backshell.

As best shown in FIGS. 4 and 5, first opening 22 is provided in the strain-relief mounting member 20. The opening 22 extends through the strain-relief mounting member 20 and is positioned on the strain-relief mounting member 20 at a portion which extends beyond the wire receiving portion 14. A securing portion 24 (FIG. 5) of the opening 22 has sidewalls 26 which have an octangular configuration. The securing portion 24 may be positioned only at one end of the opening 22 or may be provided at both ends of the opening 22. The sidewalls 26 of the securing portion 24 are configured to provide positive securing surface, which will be more fully described. While octangular sidewalls 26 are shown, the sidewalls 26 may have other configurations which provide the positive securing surfaces.

Strain relief member 30 is rotatably or pivotally mounted to strain-relief mounting member 20. The strain relief member 30 has a first portion or arm 32 and a second portion or arm 34.

As best shown in FIG. 4, the first arm 32 has a first end 36 and a second end 38. The first end has a securing projection 40 which extends therefrom. The securing projection 40 is dimensioned to be received in the securing portion 24 of the opening 22 (FIG. 5) of the strain-relief mounting member 20. The securing projection 40 has outer walls 42 which are configured to engage the sidewalls 26 of the securing portion 24 to provide positive securing. While hexangular outer walls 42 are shown, the outer walls 42 may have other configurations which provide the positive securing surfaces. However, the outer walls 42 are configured to be complementary to the configuration of the sidewalls 26. A first mounting hardware receiving opening 44 extends through the first end 36, including through the securing projection 40.

The second end 38 of the first arm 32 has a second mounting hardware receiving opening 46 which extends therethrough. The second end 38 has thickness t2 which is greater than the thickness t1 of the first end 36. A projection 48 is provided proximate the securing projection 40. The thickness of the projection 48, the securing projection 40 and the second end 38 are all approximately t2. A recess or cavity 50 extends from proximate the projection 48 to proximate the second end 38. A surface 52 (FIG. 5) of the recess 50 may have coating or texture applied thereto or formed thereon to provide a better gripping surface, as will be discussed.

The second arm 34 has a first end 56 and a second end 58. As best shown in FIG. 5, the first end has a securing projection 60 which extends therefrom. The securing projection 60 is dimensioned to be received in the opening 22 of the strain-relief mounting member 20. In the embodiment shown, the outer walls 62 of the securing projection 60 are round to allow the securing projection 60 to rotate relative to the opening 22. However, in other embodiments, the securing projection 60 may have outer walls which are configured to provide positive securing surface, similar to that of securing projection 40. A first mounting hardware receiving opening 64 extends through the first end 56, including through the securing projection 60.

The second end 58 of the second arm 34 has a second mounting hardware receiving opening 66 which extends therethrough. The second end 58 has thickness t2 which is greater than the thickness t1 of the first end 56. A projection 68 is provided proximate the securing projection 60. The thickness of the projection 68, the securing projection 60 and the second end 58 are all approximately t2. A recess or cavity 70 extends from proximate the projection 68 to proximate the second end 58. A surface 72 (FIG. 5) of the recess 70 may have coating or texture applied thereto or formed thereon to provide a better gripping surface, as will be discussed.

When assembled, the first arm 34 and second arm 36 are moved into engagement with the strain-relief mounting member 20. As this occurs, the securing projection 40 is positioned in the securing portion 24 of the opening 22, while the securing projection 60 is provided in the opening 22 on the side which does not have the securing portion 24. In alternate embodiments, in which securing projection 60 also has securing outer walls, both projections 40 and 60 would interact with securing portions 24 of the opening 22.

With the securing projections 40, 60 properly positioned in opening 22, the second end 38 of first arm 34 and the second end 58 of second arm 36 are placed in engagement. In addition the projections 48, 68 are placed in engagement. In this position, the recesses 50, 70 form a wire or cable receiving opening 80. Mounting hardware 82, 84 cooperates with the second mounting hardware receiving opening 46, 66 to maintain the strain relief member 30 in the assembled position. Mounting hardware 86, 88 cooperates with the first mounting hardware receiving opening 42, 62 to maintain the strain relief member 30 in the assembled position. In the embodiment shown, the mounting hardware is shown as nuts and bolts. However, other types of mounting hardware can be used.

In use, the opening 22 defines a pivot axis 90. Once the desired configuration angle is selected, the strain relief arms 34 and 36 are secured in place by tightening the mounting hardware 86, 88.

As shown, the sidewalls 26 of the securing portion 24 of opening 22 cooperate with the outer walls 42 of the securing projection 40 define stop positions which enable the strain relief member 30 to be locked at various defined configuration angles relative to the strain-relief mounting member 20 and relative to the wire receiving portion 14. In the embodiment shown, the hexangular shape of the outer wall 42 and securing portion 24 defines at least three defined angular configurations. With the use of other configurations of the outer wall 42 and securing portion 24, other numbers of defined angular configurations are contemplated. All such configurations are considered to be within the broad scope of the invention.

In the exemplary embodiment illustrated, the outer walls 42 of the securing projection 40 are adapted to be aligned with the sidewall 26 of the securing portion 24 of opening 22. When the mounting hardware 86, 88 is loosened, the outer walls 42 of the securing projection 40 are moved out of the opening 22 and to not engage the sidewalls 26 of the securing portion 24 of opening 22, allowing the strain relief member to be pivotably moved relative to the strain-relief mounting member 20. When the mounting hardware 86, 88 is tightened, the outer walls 42 of the securing projection 40 are moved into the opening 22 and engage the sidewalls 26 of the securing portion 24 of opening 22, causing the strain relief member to be secured in position relative to the strain-relief mounting member 20.

Figure 6:
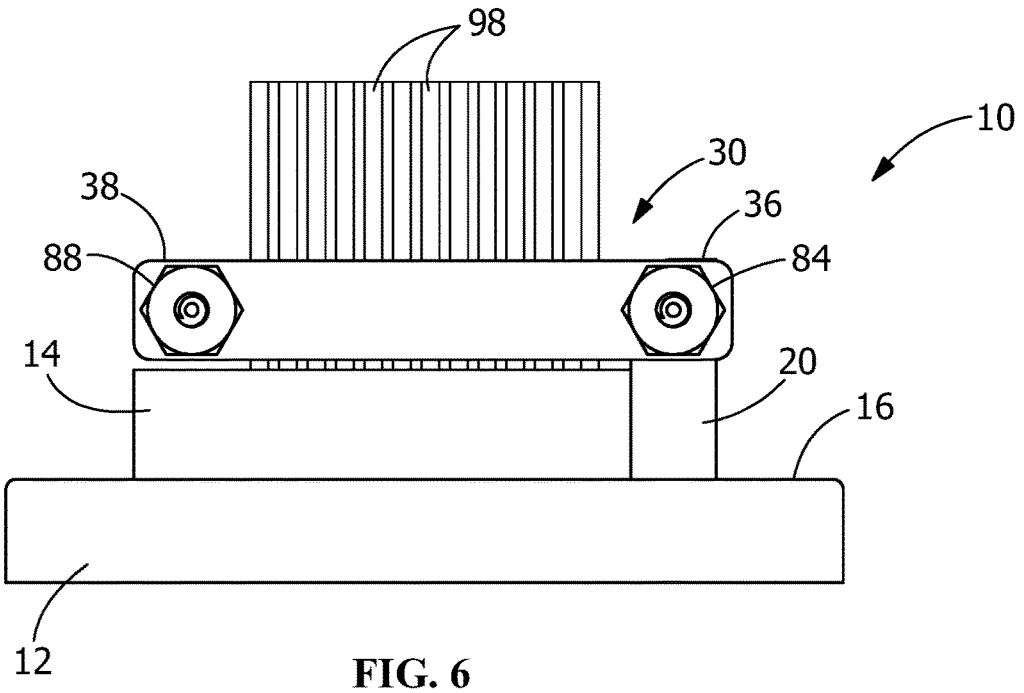
FIG. 6 is a plan view of the movable strain relief of FIG. 1 with wires positioned therein.
Figure 7:
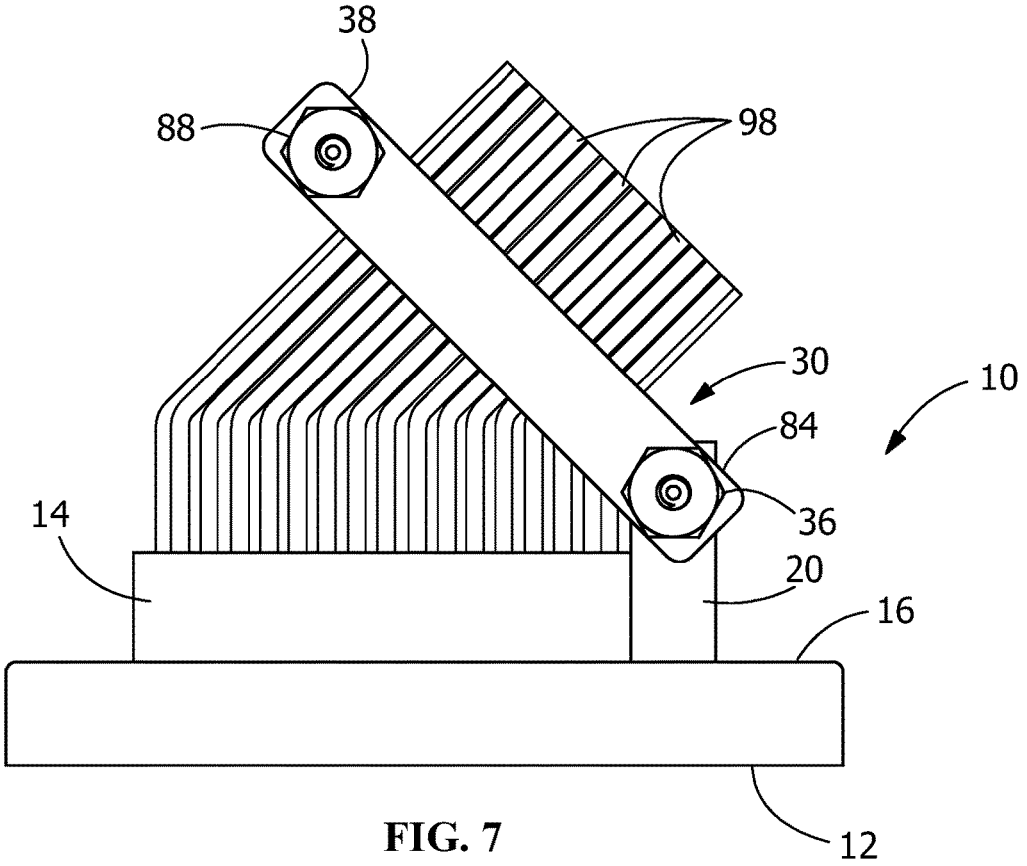
FIG. 7 is a plan view of the movable strain relief of FIG. 2 with wires positioned therein.
Figure 8:
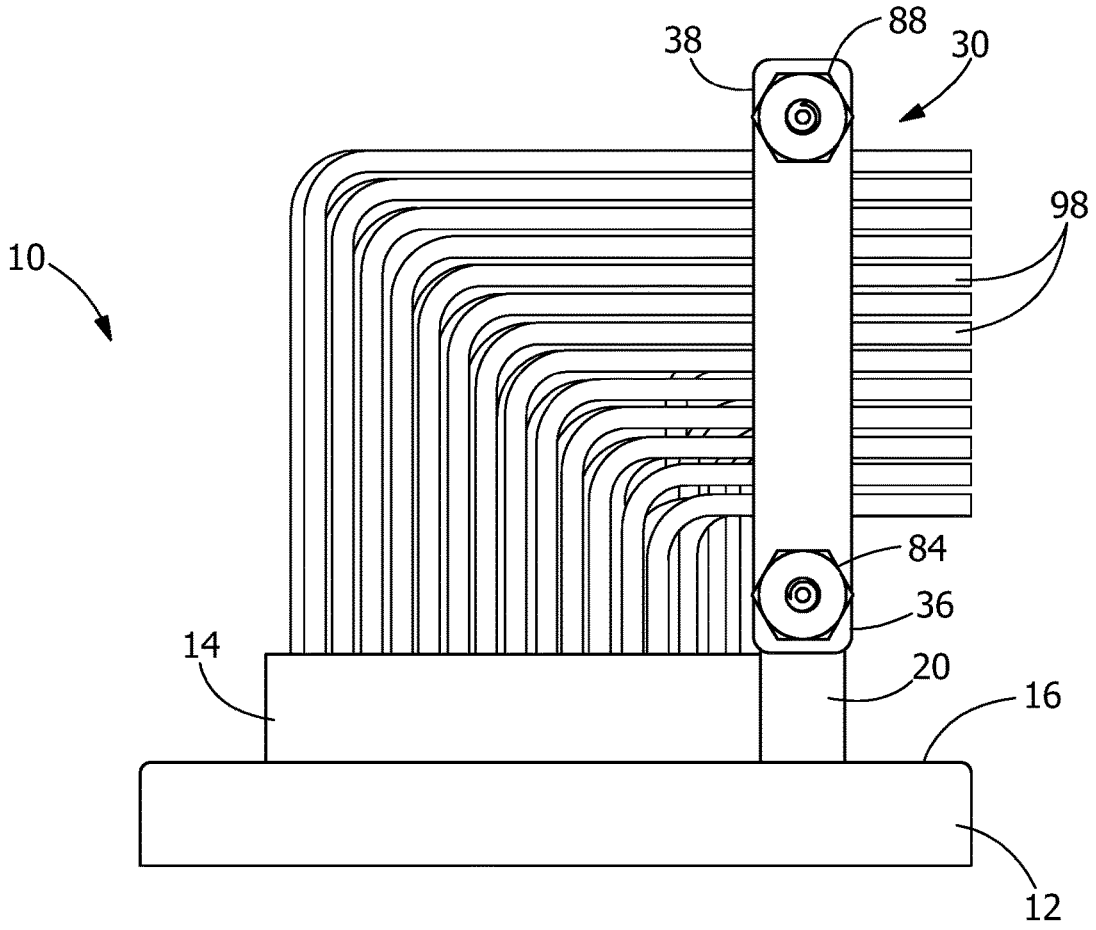
FIG. 8 is a plan view of the movable strain relief of FIG. 3 with wires positioned therein.

As shown in FIGS. 1 through 3 and 6 through 8, various configurations of the strain relief member 30 can be obtained rather quickly and easily. For example, FIGS. 1 and 6 illustrate a configuration in which the center axis 92 of the wire or cable receiving opening 80 of the strain relief member 30 is at 0 degree angle relative to the center axis 94 of the wire mounting opening of the wire receiving portion 14, supporting the wires 98 is a straight or unbent configuration. FIGS. 2 and 7 illustrate a configuration in which the center axis 92 of the wire or cable receiving opening 80 of the strain relief member 30 is at 45 degree angle relative to the center axis 94 of the wire mounting opening of the wire receiving portion 14, supporting the wires 98 is a 45 degree bent configuration. FIGS. 3 and 8 illustrate a configuration in which the center axis 92 of the wire or cable receiving opening 80 of the strain relief member 30 is at 90 degree angle relative to the center axis 94 of the wire mounting opening of the wire receiving portion 14, supporting the wires 98 is a 90 degree bent configuration. In each of these configurations, a surface of the outer wall 42 of the securing projection 40 cooperates with and is in engagement with a surface of the sidewall 26 of the securing portion 24 of opening 22 to maintain and lock the strain relief member 30 in position. Consequently, when the mounting hardware 86, 88 is tightened, the outer wall 42 cooperates with the sidewall to prevent rotation of the strain relief member 30 relative to the backshell assembly 10.

The movable or pivotable strain relief member 39 is adapted to rotate between various angles, for example 0 degrees to 90 degrees, defined between an the axis 92 of the backshell assembly and the axis 94 of the strain relief member 30. While the strain relief member 30 of the embodiment shown has defined positions of 0 degrees, 45 degrees and 90 degrees, other defined positions may be provided by altering the shape of the securing projection 40 and the securing portion 24 of the opening 22. The backshell assembly in accordance with the present invention eliminates the needs to provide separate tooling for backshell adapter assemblies having different configurations.

While specific locking hardware or mechanisms are shown with specific defined positions, the principles of the present invention are applicable to embodiments with various types of locking mechanisms in addition to those shown and embodiments without defined positions. It is only important that the strain relief member be secured in place after the strain relief member has been configured to the desired angle.

In the illustrative embodiment shown, the strain relief member is configured to be used with a backshell assembly of a micro-D connector. However, the strain relief member can be used with other types of connectors. Additionally, the principles of the present invention are applicable to both shielded and non-shielded cable or wire applications.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A backshell assembly with a strain relief member, comprising:

an enclosure member for positioning over a connector, the enclosure member having a wire receiving portion which extends from a surface of the enclosure member;

a strain relief mounting member extending from the enclosure;

a strain relief member movably mounted to the strain relief mounting member, wherein the strain relief member is movable between 0 degrees and 90 degrees as measured between a center axis a wire mounting opening of the wire receiving portion to a center axis of a wire receiving opening of the strain relief member, the strain relief member having two arms which are joined together to form the wire receiving opening through which wires or a cable extend;

mounting hardware extending through a first opening in the strain relief mounting member and second openings in a first end of the strain relief member, the mounting hardware cooperates with the first opening to provide stops to position and maintain the strain relief member relative to the wire receiving portion;

securing hardware extending through securing openings provided at second ends of the arms opposite to the first ends, the securing hardware secures the second ends together.

2. The backshell assembly as recited in claim 1, wherein the first opening has hexagonal sidewalls at one end, the hexagonal sidewalls cooperate with a hexagonal nut of mounting hardware to maintain the strain relief member at 0 degrees, 45 degrees and 90 degrees, relative to the cable receiving portion when the mounting hardware is tightened.

3. The backshell assembly as recited in claim 1, wherein the strain relief mounting member extends from the surface of the enclosure proximate a side of the cable receiving portion.

4. The backshell assembly as recited in claim 1, wherein the wire receiving opening is dimensioned to grip the wires or cable to prevent unwanted movement of ends of the wires or cable positioned in the wire mounting opening.

5. The backshell assembly as recited in claim 1, wherein surfaces of wire receiving opening are coated to facilitate gripping of the wires or cable in the wire receiving opening.

6. A backshell assembly with a strain relief member, comprising:

an enclosure member for positioning over a connector, the enclosure member having a wire receiving portion which extends from a surface of the enclosure member;

a strain relief mounting member extending from the enclosure;

a strain relief member movably mounted to the strain relief mounting member, wherein the strain relief member is movable as measured between a center axis a wire mounting opening of the wire receiving portion to a center axis of a wire receiving opening of the strain relief member;

wherein mounting hardware cooperates with the strain relief mounting member and the strain relief member, the mounting hardware provides stops to position and maintain the strain relief member at 0 degrees, 45 degrees and 90 degrees relative to the wire receiving portion of the enclosures;

the mounting hardware extending through a first opening in the strain relief mounting member and second openings in a first end of the strain relief member, the first opening having sidewalls at one end, the sidewalls cooperate with a nut of the mounting hardware.

7. The adjustable strain relief assembly as recited in claim 6, wherein the strain relief mounting member extends from the surface of the enclosure proximate a side of the cable receiving portion.

8. The adjustable strain relief assembly as recited in claim 7, wherein the strain relief member has two arms which are joined together to form an wire receiving opening through which wires or a cable extend.

9. An adjustable strain relief assembly for use with a connector, the strain relief assembly comprising:

a strain relief mounting member extending from the connector;

a strain relief member movably mounted to the strain relief mounting member, wherein the strain relief member is movable between 0 degrees and 90 degrees as measured between a center axis of a wire mounting opening of the connector to a center axis of a wire receiving opening of the strain relief member, the strain relief member having two arms which are joined together to form the wire receiving opening through which wires or a cable extend;

mounting hardware extending through a first opening in the strain relief mounting member and second openings in a first end of the strain relief member, the mounting hardware cooperates with the first opening to provide stops to position and maintain the strain relief member at 0 degrees, 45 degrees and 90 degrees relative to the wire receiving portion;

securing hardware extending through securing openings provided at second ends of the arms opposite to the first ends, the securing hardware secures the second ends together.

10. The adjustable strain relief assembly as recited in claim 9, wherein the first opening has hexagonal sidewalls at one end, the hexagonal sidewalls cooperate with a hexagonal nut of the mounting hardware to maintain the strain relief member at 0 degrees, 45 degrees and 90 degrees, relative to the wire mounting opening of the connector when the mounting hardware is tightened.

11. The adjustable strain relief assembly as recited in claim 10, wherein the strain relief mounting member extends from a surface of the connector proximate a side of the wire mounting opening of the connector.

12. The adjustable strain relief assembly as recited in claim 11, wherein the wire receiving opening is dimensioned to grip the wires or cable to prevent unwanted movement of ends of the wires or cable positioned in the wire mounting opening of the connector.

13. The adjustable strain relief assembly as recited in claim 12, wherein surfaces of in the wire mounting opening are coated to facilitate gripping of the wires or cable in the wire receiving opening.

* * * * *